US011825895B2

(12) United States Patent
Iacono

(10) Patent No.: US 11,825,895 B2
(45) **Date of Patent: *Nov. 28, 2023**

(54) GLOVE FOR CONFORMING TO HANDS OF VARIOUS SIZES

(71) Applicant: Zero Friction, LLC, Oakbrook Terrace, IL (US)

(72) Inventor: John R. Iacono, Elmhurst, IL (US)

(73) Assignee: ZERO FRICTION, LLC, Oak Brook Terrace, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/978,301

(22) Filed: Nov. 1, 2022

(65) Prior Publication Data

US 2023/0051543 A1 Feb. 16, 2023

Related U.S. Application Data

(63) Continuation of application No. 17/492,501, filed on Oct. 1, 2021, now Pat. No. 11,700,895, which is a continuation of application No. 16/384,838, filed on Apr. 15, 2019, now Pat. No. 11,134,732, which is a continuation of application No. 15/178,270, filed on Jun. 9, 2016, now Pat. No. 10,258,094, which is a continuation of application No. 15/057,347, filed on Mar. 1, 2016, now Pat. No. 9,375,038, which is a continuation of application No. 14/513,451, filed on Oct. 14, 2014, now Pat. No. 9,302,171.

(51) Int. Cl.

| | |
|---|---|
| ***A41D 19/015*** | (2006.01) |
| ***A63B 71/14*** | (2006.01) |
| ***A41D 19/00*** | (2006.01) |

(52) U.S. Cl.

CPC ..... *A41D 19/01547* (2013.01); *A41D 19/0006* (2013.01); *A63B 71/143* (2013.01); *A63B 71/146* (2013.01); *A63B 71/148* (2013.01); *A63B 71/141* (2013.01); *A63B 2209/00* (2013.01); *A63B 2209/10* (2013.01); *A63B 2225/09* (2013.01)

(58) Field of Classification Search

CPC ..... A41D 19/01547; A41D 19/00; A63B 71/148; A63B 71/146; A61B 19/04

See application file for complete search history.

(56) References Cited

U.S. PATENT DOCUMENTS

| | | | |
|---|---|---|---|
| 1,149,139 | A | 8/1915 | Heagle |
| 1,625,368 | A | 4/1927 | Kurz |
| 2,226,604 | A | 12/1940 | Geissmann |
| 2,488,416 | A | 11/1949 | Kurz |
| 2,554,991 | A | 5/1951 | Kramer |
| 2,707,286 | A | 5/1955 | Silver |

(Continued)

*Primary Examiner* — Tajash D Patel

(74) *Attorney, Agent, or Firm* — LeFevour Law, LLC; Martin T. LeFevour

(57) ABSTRACT

A glove has a palm side and a back side joined at a side edge to form a glove body. The palm side and the back side are constructed from a stretch material. Panels attach to the stretch material on the palm side to form finger parts, palm parts and a back part. The panels are separated from each other by the stretch material to allow relative movement. Elastic bands attached to the panels on the back side adjust the fit. A thumb part has a gusset of the stretch material. Grip surfaces have an embossed texture with indentations.

20 Claims, 5 Drawing Sheets

(56) References Cited

U.S. PATENT DOCUMENTS

| | | | |
|---|---|---|---|
| 2,907,046 | A | 10/1959 | Scherr |
| 3,597,765 | A | 8/1971 | Stanton |
| 5,117,509 | A | 6/1992 | Bowers |
| 5,511,248 | A | 4/1996 | Widdemer |
| 5,708,979 | A | 1/1998 | Redwood |
| 5,893,172 | A | 4/1999 | Haynes et al. |
| 5,926,847 | A | 7/1999 | Eibert |
| 6,154,885 | A | 12/2000 | Kobayashi et al. |
| 6,216,276 | B1 | 4/2001 | Elbert |
| 6,405,380 | B1 | 6/2002 | Kuroda et al. |
| 6,415,445 | B1 | 7/2002 | Nishijima et al. |
| 6,543,058 | B2 | 4/2003 | Litke |
| 6,655,269 | B2 | 12/2003 | Litke |
| 7,536,730 | B2 | 5/2009 | Estrella |
| 7,882,571 | B2 | 2/2011 | Robba et al. |
| 8,225,426 | B2 | 7/2012 | Bevier |
| 8,453,266 | B2 | 6/2013 | Bevier et al. |
| 8,863,317 | B2 | 10/2014 | Tsuru et al. |
| 9,302,171 | B1 | 4/2016 | Iacono |
| 9,375,038 | B1 | 6/2016 | Iacono |
| 9,656,150 | B2 | 5/2017 | Tan |
| 11,134,732 | B2 | 10/2021 | Iacono |
| 2006/0026738 | A1 | 2/2006 | Kleinert |
| 2007/0083968 | A1 | 4/2007 | Stokes |
| 2007/0226873 | A1 | 10/2007 | Mattesky |
| 2008/0109934 | A1 | 5/2008 | Widdemer |
| 2010/0077526 | A1 | 4/2010 | Smeltzer |
| 2010/0186142 | A1 | 7/2010 | Kume |
| 2010/0275342 | A1 | 11/2010 | Sweeney |
| 2012/0227155 | A1 | 9/2012 | Brown |
| 2013/0263356 | A1 | 10/2013 | Jones et al. |
| 2014/0059739 | A1 | 3/2014 | Gellis |
| 2014/0143926 | A1 | 5/2014 | Brown |
| 2016/0073711 | A1* | 3/2016 | Fitzgerald ..... A41D 19/0006 2/161.6 |
| 2020/0397075 | A1* | 12/2020 | Iacono ..... A41D 19/01558 |

* cited by examiner

GLOVE FOR CONFORMING TO HANDS OF VARIOUS SIZES

CROSS REFERENCE TO RELATED APPLICATIONS

This application is a continuation application of U.S. Ser. No. 17/492,501 filed on Oct. 1, 2021, which is a continuation of U.S. Ser. No. 16/384,838 filed on Apr. 15, 2019, now issued as U.S. Pat. No. 11,134,732, which is a continuation application of U.S. Ser. No. 15/178,270 filed on Jun. 9, 2016, now issued as U.S. Pat. No. 10,258,094, which is a continuation of U.S. Ser. No. 15/057,347 filed on Mar. 1, 2016, now issued as U.S. Pat. No. 9,375,038, which is a continuation of U.S. application Ser. No. 14/513,451 filed Oct. 14, 2014, now issued as U.S. Pat. No. 9,302,171.

BACKGROUND OF THE INVENTION

The present invention generally relates to a glove. More specifically, the present invention relates to a glove that is designed to conform to hands of various sizes.

Athletic gloves are commonly worn by athletes in a variety of sports. Gloves are generally worn by athletes to reduce blistering on their hands. Moreover, gloves are commonly worn by athletes to improve their grip on sporting equipment, such as bats, rackets and golf clubs.

In the sport of golf, a golfer swings his or her golf club to strike a golf ball with the face of the club. A golf glove is known to be worn by golfers on his or her hand. A golf glove is also generally known to provide for an enhanced grip when swinging the golf club. The grip on the golf club provides for better control during the swing of the golfer that leads to a longer, more accurate shot. The firm grip helps reduce twisting of the club when striking the golf ball. When the golf club twists during the swing, the face of the club head rotates prior to striking the ball. This rotation causes the golf ball to travel left or right of the desired trajectory.

Golf gloves are typically made from materials that reduce slipping of the golf club in the hand of the golfer. For example, gloves are made from either leather and/or synthetic material. Leather and/or synthetic material create friction between the glove and the golf club during the swing of the golfer. The friction reduces slipping of the golf club which in turn provides the golfer with a firmer grip.

The golf glove must also fit snugly on the hand of the golfer to ensure a firm grip. A glove that fits loosely on the hand of the golfer allows the glove to move during the swing of the golfer. If the glove moves, the golfer may not maintain a firm grip on the club.

Thus, a golf glove that fits snugly to the hand of the golfer is desirable. The leather and/or synthetic material used in typical golf gloves do not stretch. As a result, a necessity exists for gloves to be manufactured in different sizes so golfers may purchase gloves that fit properly. However, even with different sized glove options, the golfer still may not find a glove that fits well on his or her hand. Additionally, a golfer whose hand size has changed must buy a new glove that fits.

As a result, retailers must stock and display a variety of gloves. Stocking a variety of gloves may lead to the retailer having a surplus of sizes for a particular glove. The demand for certain styles of golf gloves may constantly change which may result in the retailer being unable to sell the surplus of gloves. Further, numerous sizes of a variety of gloves for men and for women may require a large amount of shelf space and/or hanging rack space to display every available size of glove. Retailers may have limited shelf space and may be unable to carry such a large variety of gloves in all of the available sizes.

A need, therefore, exists for a glove that is designed to conform to hands of various sizes.

SUMMARY OF THE INVENTION

The present invention generally relates to a glove. More specifically, the present invention relates to an athletic glove with gripping features that is designed to stretch to conform to hands of various sizes.

To this end, in an embodiment of the present invention, a glove with gripping features designed to stretch and fit hands of all sizes is provided. The glove may have a palm side and a back side joined at a side edge to form a glove body. The palm side and the back side are constructed from a stretch material. A first panel attaches to the stretch material on the palm side to form an index finger part, a middle finger part, a ring finger part and a pinky finger part. A second panel attaches to the stretch material on the palm side to form a palm part. The second panel is separated from the first panel by the stretch material. A third panel attaches to the stretch material on the back side, and a thumb part attaches to the stretch material on the palm side. The stretch material forms a gusset in the thumb part. A first elastic band attaches to the back side and is stitched to the third panel and the stretch material. In an embodiment, gussets connect the palm side to the back side and are continuous from the tip of the index finger to the tip of the pinky finger.

In an embodiment, the first panel attaches to the index finger and is continuous from the pinky finger part to the back side of the index finger.

In an embodiment, a fourth panel attaches to the palm part and overlaps the second panel.

In an embodiment, a fifth panel attaches to the stretch material on the back side and is separated from the third panel by the stretch material.

In an embodiment, a second elastic band attaches to the interior of the glove body and is stitched to the third panel and the stretch material. The second elastic band extends from the side edge to the back side.

In an embodiment, the second panel is separated from the first panel by the stretch material.

In an embodiment, the second panel is separated from the thumb part by the stretch material.

In an embodiment, the first panel has holes extending through the middle finger part, the ring finger part and the pinky finger part.

In an embodiment, a flap is located on the back side. The flap and the back side have paired hook and loop fasteners.

In an embodiment, a closure is formed on the back side and has a flexible part configured to fasten to a fixed part.

In an embodiment, a tab attaches to the back side to form a loop.

In an embodiment, a notch is located on the index finger part of the first panel.

In an embodiment, a wrist panel attaches to the body wherein the stretch material abuts the wrist panel.

In another embodiment, a glove has a body with a palm side and a back side. The body is constructed from a stretch material and has a finger portion to receive fingers therein, a thumb portion and a palm portion. Panels attach to the body and are separated by the stretch material. The panels move relative to each other. A thumb part with a side edge connects to the stretch material at the side edge.

In an embodiment, a slit is formed in the back side of the body.

In an embodiment, gussets attach to the stretch material and one of the panels attached to the finger portion. The gussets are continuous along the finger portion.

In a further embodiment, a glove formed in a shape of a hand is provided. The glove has a body with a palm part, a finger part, a thumb part and a back part. The body is constructed from an elastic mesh material. Grip surfaces attach to the elastic mesh material on the palm part, the finger part and the thumb part. The grip surfaces may have a texture embossed thereon.

In an embodiment, the grip surfaces have a pattern of indentations configured to provide improved grip.

In an embodiment, the glove may have synthetic material extending from the palm side of the index finger around to the back side of the index finger.

In an embodiment, the palm side of the index finger may have a slit cut into the synthetic material so that the stretch material is exposed.

In an embodiment, the glove may have gussets made from an elastic material between the index, middle, ring, and little fingers. The gussets may provide elasticity, may provide support and may reduce twisting on the fingers when playing golf.

In an embodiment, the palm side may have an additional synthetic panel sewn onto to the synthetic material on the palm for additional durability.

In an embodiment, the back side may have synthetic material extending from a wrist end up to the joints of the middle, ring, and little fingers.

In an embodiment, the back side may have a Velcro® (a registered trademark of Velcro Industries LLC) closure at the opening at the wrist end. An elastic band may be connected to the closure for an improved fit.

In an embodiment, an elastic band may be connected around an opening at a wrist end for an improved fit.

In an embodiment, the back side may have an elastic band across the knuckles for an improved fit.

In an embodiment, the palm side may have vent holes on the middle, ring, and little fingers.

In an embodiment, the back side may have an elastic loop that may be used as a tee holder.

It is, therefore, an advantage of the present invention to provide a glove that is designed to stretch to conform to hands of various sizes.

Another advantage of the present invention is to provide a glove that may provide a golfer with a firm grip on the golf club during play.

A further advantage of the present invention is to provide a glove which may allow for a more natural feel during play.

An advantage of the present invention is to provide a glove which may provide for an improved fit around the knuckle.

Still another advantage of the present invention is to provide a glove that may provide for an improved fit between the fingers.

Yet another advantage of the present invention is to provide a glove that may prevent against the golf club from twisting during play.

Another advantage of the present invention is to provide a glove which may provide for an improved fit around the wrist.

An advantage of the present invention is to provide a glove which does not move on the hand of the golfer during play.

A further advantage of the present invention is to provide a glove that is durable.

Moreover, another advantage of the present invention is to provide a glove that may be used by more than one golfer.

Additional features and advantages of the present invention described in, and will be apparent from, the detailed description of the presently preferred embodiments and from the drawings.

DETAILED DESCRIPTION OF THE PRESENTLY PREFERRED EMBODIMENTS

Figure 1:
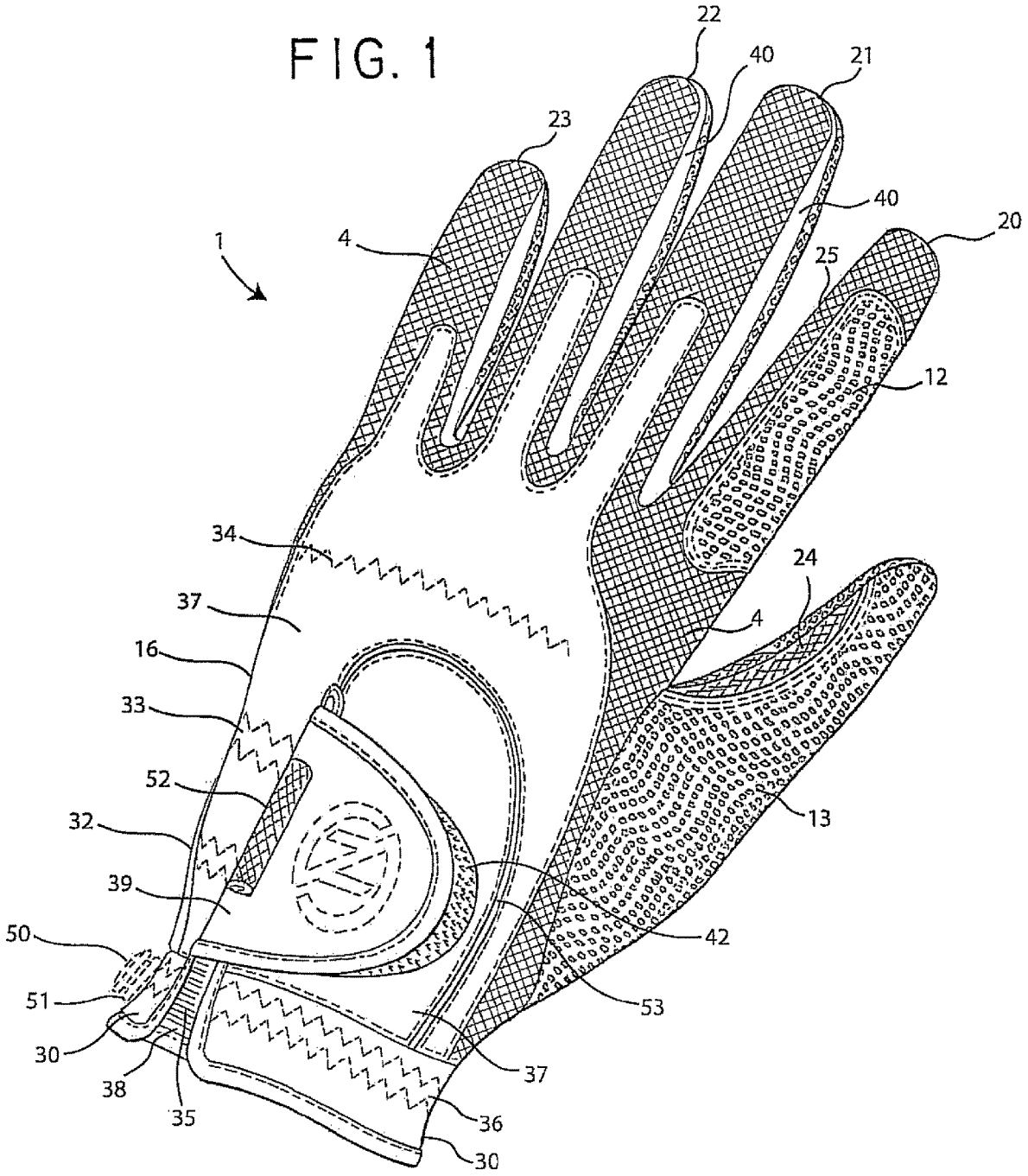
FIG. 1 illustrates a perspective view of a glove in an embodiment of the present invention.

The present invention generally relates to a universal fit athletic glove. More specifically, the present invention relates to a glove that is designed to conform to various sizes of hands of different wearers. The glove may be an athletic glove for a variety of sports, such as golf, racquet sports, baseball, football, snow skiing, water skiing, weightlifting and the like. The glove may also be used as a work glove for a variety of tasks.

Referring now to the drawings, wherein like numerals refer to like parts, FIGS. 1-7 illustrate various views of an embodiment of a glove 1. The glove 1 has a palm side 2 and a back side 3. The palm side 2 and the back side 3 maybe constructed at least partially from a stretch material 4. The stretch material 4 may be a mesh material, an elastic material and/or the like, for example, that may stretch and/or may contract. The stretch material 4 may also allow for breathability of the glove 1. For example, mesh construction of the stretch material 4 may allow heat and/or perspiration from inside the glove 1 to escape. The stretch material 4 may be made from nylon, Lycra® (a registered trademark of Invista Corporation), spandex and/or the like or any combination of such materials. Elastic bands shown in locations 32, 33 and 34 may be stitched to the stretch material 4 using, for example, zig-zag stitching and may be located within an interior 5 of the glove 1. The stitching may increase the ability of the stretch material 4 to stretch and/or to contract. Moreover, the ability of the stretch material 4 to stretch and/or to contract may allow the glove 1 to fit on the hand.

The palm side 2 may connect at a side edge portion 16 to the back side 3 to form the glove 1. The glove 1 may have an index finger 20, a middle finger 21, a ring finger 22 and a pinky finger 23. The glove 1 may be constructed using single stitching and/or double stitching, as desired, in certain locations. Preferably, the thread may be a multilayered, glued and/or lubricated polyester thread which may provide increased durability and elasticity. The increased elasticity may allow the glove 1 to fit snugly on a hand.

Figure 3:
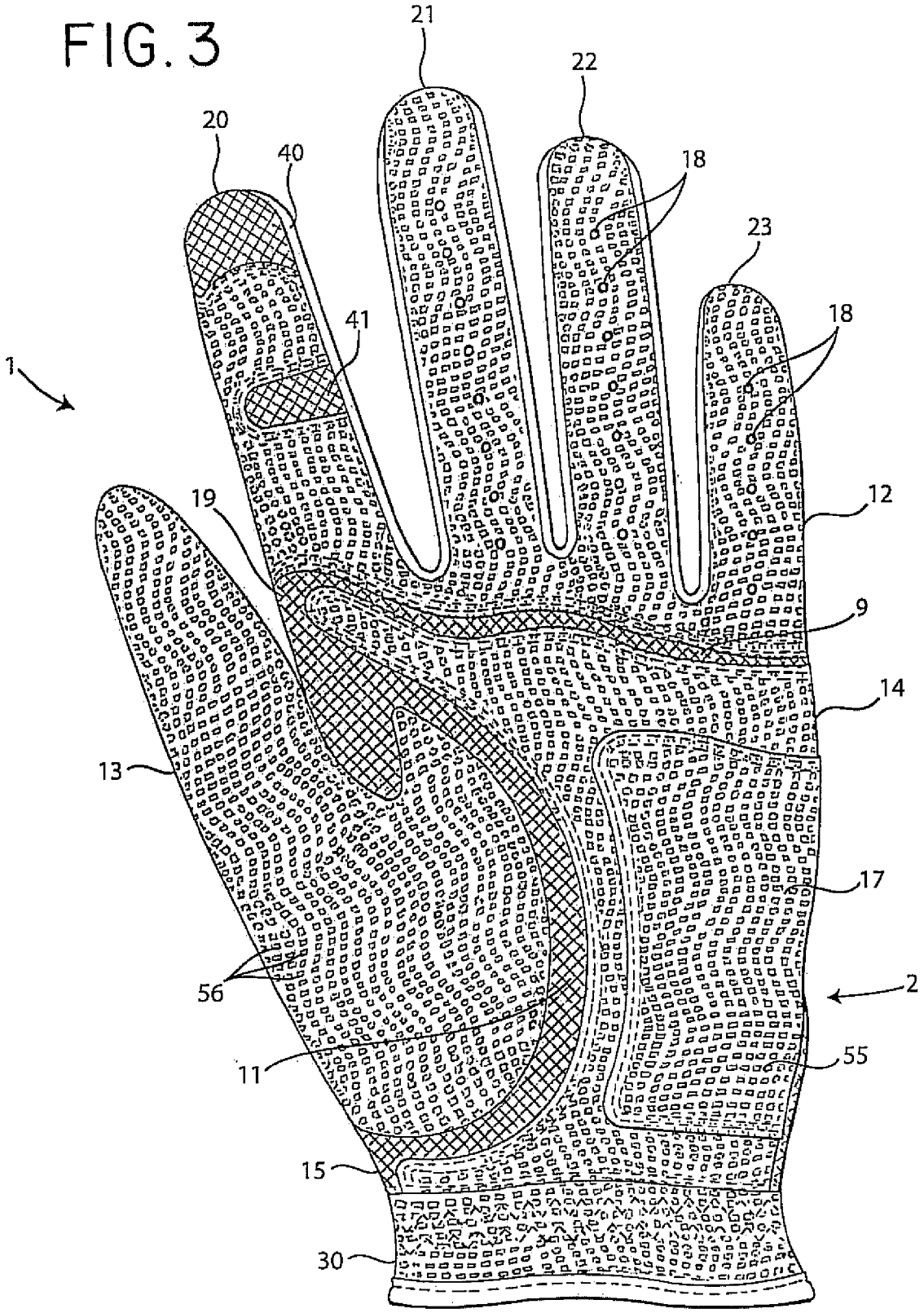
FIG. 3 illustrates a plan view of a palm side of a glove in an embodiment of the present invention.

Referring now to FIG. 3, the glove 1 may have the palm side 2 as shown. The palm side 2 may have a finger panel 12 and/or a palm panel 14 that may be sewn to the stretch material 4. The finger panel 12 and/or the palm panel 14 may be made from a material that may provide grip for a user. Further, the material for the finger panel 12 and/or the palm panel 14 may have non-slip properties. The finger panel 12 and/or the palm panel 14 may be made from leather, synthetic leather and/or the like. Synthetic leather may be made from, for example, a blend of polyester and polyurethane. For example, a preferred blend may be fifty percent polyester and fifty percent polyurethane. The finger panel 12 and/or the palm panel 14 may be sewn to the stretch material 4 using single stitching and/or double stitching of the thread.

The palm side 2 may have the finger panel 12 that may form the palm side 2 of the index finger 20, the middle finger 21, the ring finger 22, and the pinky finger 23. The finger panel 12 may have vent holes 18 on the middle finger 21, the ring finger 22 and/or the pinky finger 23. The vent holes 18 may provide ventilation for the hand of a wearer of the glove 1. During use, the wearer may become hot and/or may perspire. The vent holes 18 may allow heat and/or perspiration from inside the glove 1 to escape through the vent holes 18.

Figure 2:
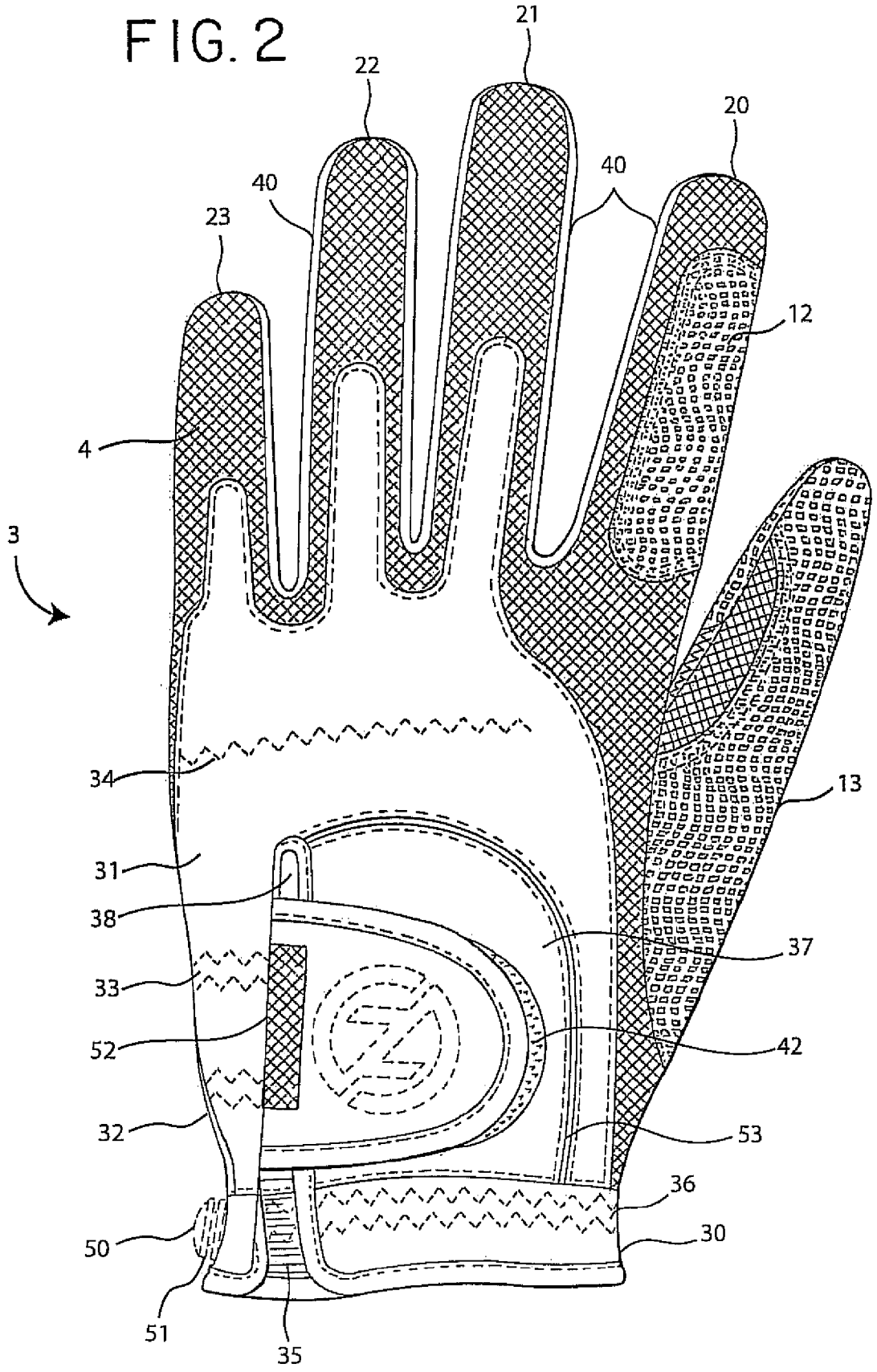
FIG. 2 illustrates a plan view of a back side of a glove in an embodiment of the present invention.
Figure 4:
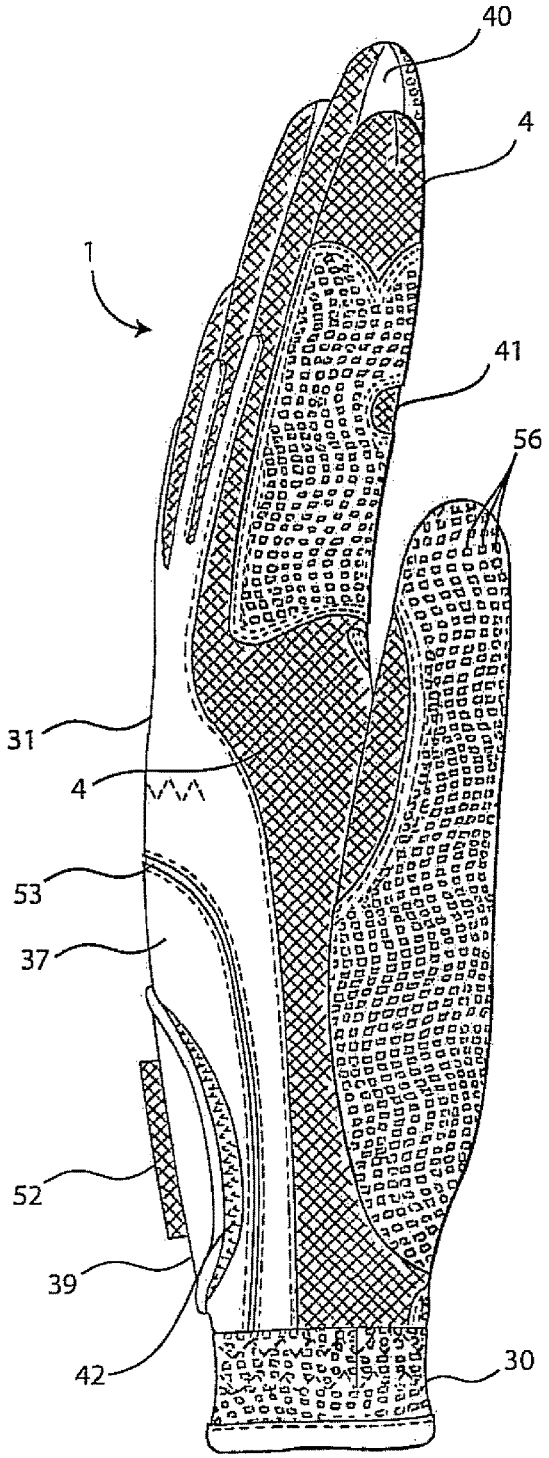
FIG. 4 illustrates a side view of a glove in an embodiment of the present invention.

The finger panel 12 may be attached to the stretch material 4 at the base of the index finger 20, the middle finger 21, the ring finger 22 and the pinky finger 23. As shown in FIGS. 1, 2 and 4, the finger panel 12 may continue around a back side portion 25 of the index finger 20. The panel 12 may attach to the stretch material 4 at the backside portion 25 of the index finger 20. The material on the back side portion 25 may reduce slipping of the golf club when the club is gripped. The finger panel 12 may have a section 41 that may be removed at the second joint of the index finger 20 to expose the stretch material 4. The section 41 may allow the index finger part 20 to bend.

The palm side 2 of the glove 1 may have a thumb part 13 that may be sewn to the stretch material 4. The palm side 2 may also have the palm panel 14 that may be sewn on the stretch material 4. An additional panel 17 may be sewn on the palm panel 14. The additional panel 17 may improve integrity and/or durability of the glove 1.

Referring to FIG. 3, the finger panel 12, the thumb part 13 and/or the palm panel 14 may be sewn on the stretch material 4 to allow the glove 1 to expand and/or to contract. A first strip 9 of stretch material 4 may be exposed between the palm panel 14 and the finger panel 12. The first strip 9 may separate the finger panel 12 from the palm panel 14.

As shown in FIG. 3, a second strip 11 of stretch material 4 may separate the thumb part 13 from the palm panel 14. The second strip 11 of the stretch material 4 may begin at a wrist end 15 and may end at an area 19 of the index finger 20. The second strip 11 of the stretch material 4 may intersect with the first strip 9 of the stretch material 4 at the area 19 of the index finger 20. The first strip 9 and/or the second strip 11 of the stretch material 4 may increase the ability of the glove 1 to stretch and/or to contract.

As shown in FIGS. 1-3, the glove 1 may have a wrist panel 30. In an embodiment, the wrist panel 30 may be sewn to the stretch material 4 adjacent to the wrist end 15. The wrist panel 30 may be distinct from the stretch material 4 and may be constructed from leather, synthetic leather and/or the like. The wrist panel 30 may have an elastic band.

Referring to FIGS. 1 and 2, the glove 1 may have the back side 3 as shown. The stretch material 4 may be continuous from the wrist end 15 to the tips of the index finger 20, the middle finger 21, the ring finger 22 and the pinky finger 23. The back side 3 may have a back panel 31 and an inset panel 37 that may be sewn to the stretch material 4. The back panel 31 may extend to the wrist end 15. The back panel 31 may also be sewn to the stretch material 4 at the middle finger 21, the ring finger 22 and the pinky finger 23. The back panel 31 may be sewn to the stretch material 4 at the joints to provide the glove 1 with increased stretchability and/or contractibility. A ball marker 50 may be attached to the panel 31 near the wrist end portion 30. The ball marker 50 may detach from a snap base 51. The wearer of the glove 1 may use the ball marker 50 to mark a location of a golf ball on a putting green.

The back side 3 may have the thumb part 13 connected to the stretch material 4. The stretch material 4 may be exposed continuously from the wrist end 15 to tips of the index finger 20, the middle finger 21, the ring finger 22 and the pinky finger 23. The stretch material 4 may separate the back panel 31 from the thumb part 13. The thumb part 13 may have a side edge 24 and may be connected to the stretch material 4 at the side edge 24. The side edge 24 may allow the glove 1 to stretch at the thumb part 13 so that the glove 1 may conform to the hand.

The back side 3 may have a slit 38. The slit 38 may allow removal of the glove 1. The slit 38 may also allow the wearer to access the interior 5 of the glove 1. The slit 38 may be closed using a flap 39 that may have a hook-and-loop closure 42, for example. The hook-and-loop closure 42 may be a Velcro® (a registered trademark of Velcro Industries LLC) fastener. The flap 39 and the hook-and-loop closure 42 may allow tightening and/or loosening of the glove 1 as needed. The flap 39 may have an elastic loop 52 attached. The elastic loop 52 may serve as a tee holder. For example, the wearer of the glove 1 may insert a tee (not shown) into the elastic loop 52.

In an embodiment, the flap 39 may be connected to the back panel 31. The hook-and-loop closure 42 may be connected to the inset panel 37 that may be separated from the back panel 31 by an arc 53 of the stretch material 4. The arc 53 may extend from the slit 38 to the wrist end portion 30. The exposed stretch material 4 may improve the fit by expanding and/or contracting when the glove 1 is worn.

Figure 6:
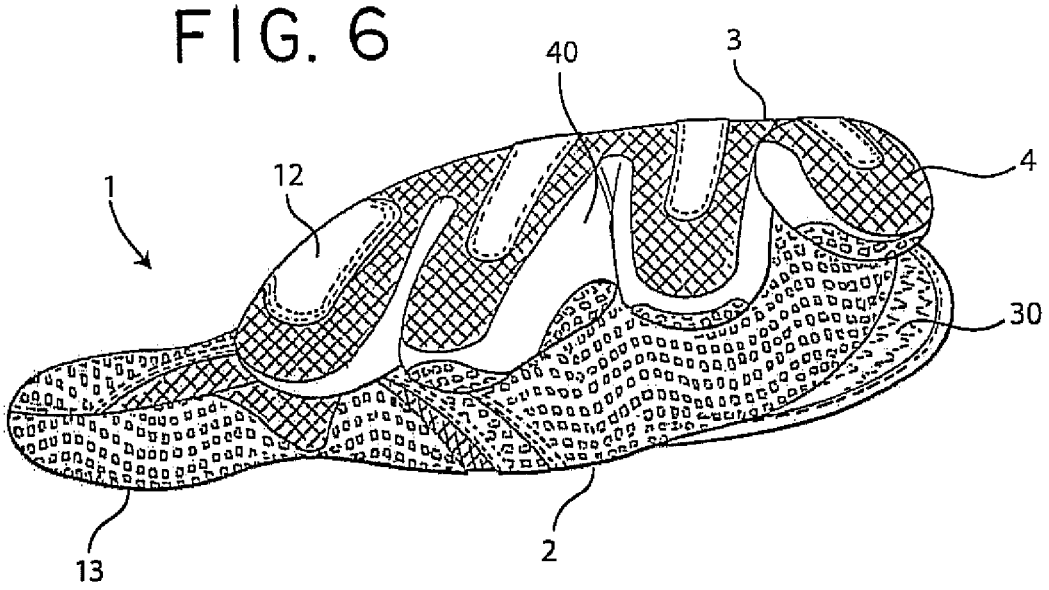
FIG. 6 illustrates a top end view of a glove in an embodiment of the present invention.
Figure 7:
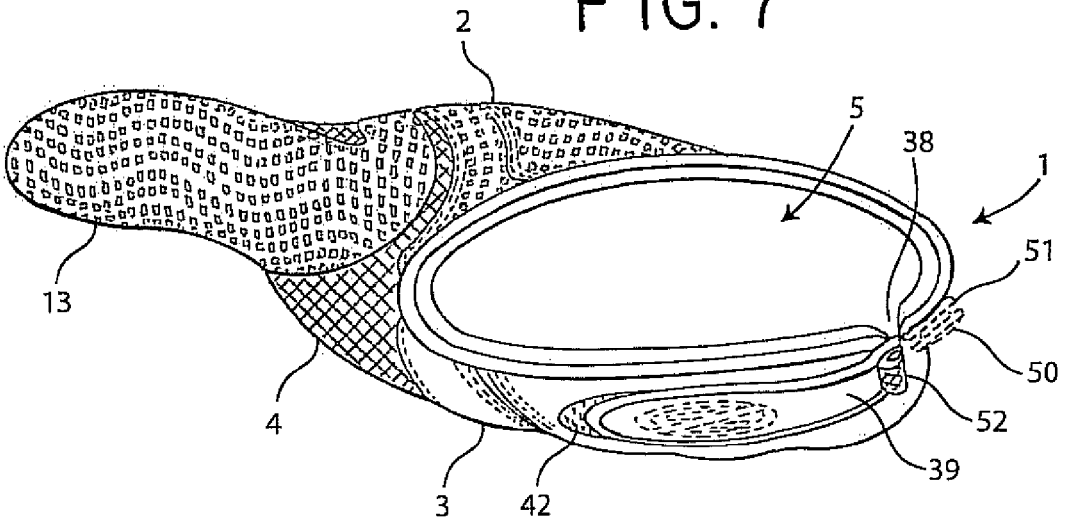
FIG. 7 illustrates a bottom end view of a glove in an embodiment of the present invention.

Referring to FIG. 6, the glove 1 may have gussets 40 made from an elastic material, for example. The gussets 40 may connect the palm side 2 to the back side 3 at the index finger 20, the middle finger 21, the ring finger 22 and the pinky finger 23. The gussets 40 may be continuous from the tip of the index finger 20 to the tip of the pinky finger 23. The gussets 40 may allow enlargement and/or expansion of the glove 1 to conform to various hand sizes at the fingers. Moreover, the gussets 40 may provide support and/or may reduce twisting of the fingers during play. Preferably, the gussets 40 may be a Lycra® material (a registered trademark of Invista Corporation).

As illustrated in FIGS. 1 and 2, the glove 1 may have an elastic band 34 that may be sewn from the side edge portion 16 to an area on the back of the hand below the fingers. The elastic band 34 may provide the glove 1 with increased stretchability and/or contraction. In an embodiment, the elastic band 34 may be sewn to the stretch material 4, for example, using a zig-zag stitch. The stitch may improve the elasticity of the elastic band 34 by expanding and/or contracting. Thus, the elastic band 34 may improve the fit of the glove 1.

Figure 5:
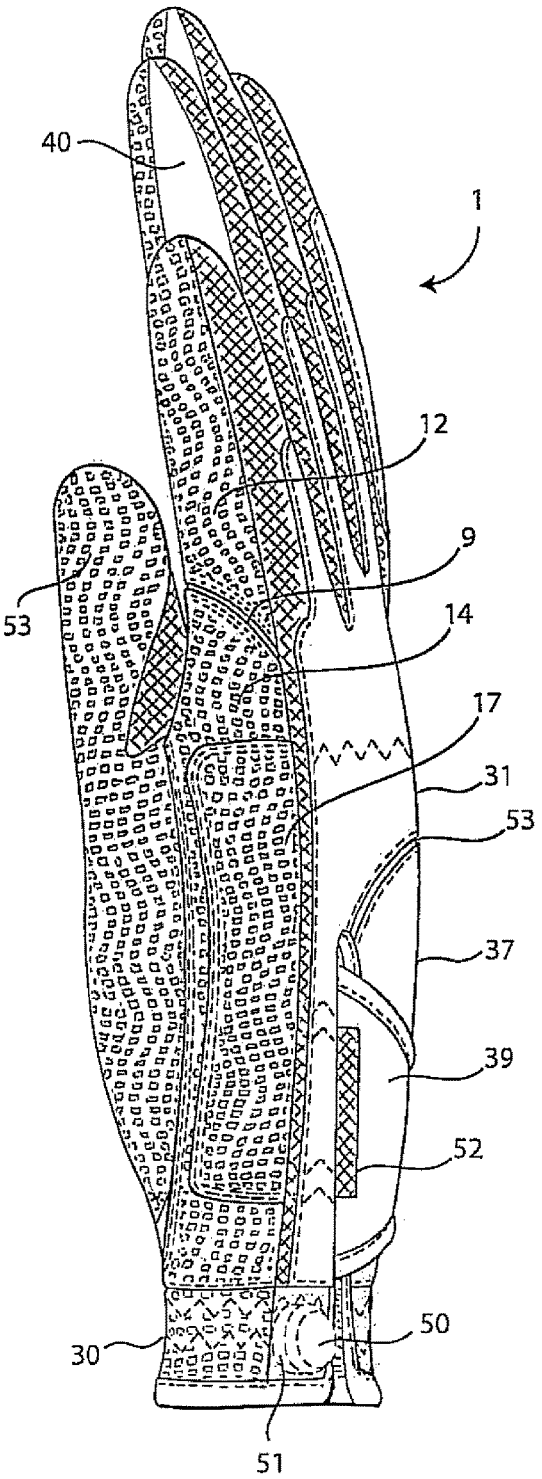
FIG. 5 illustrates a side view of a glove in an embodiment of the present invention.

The glove 1 may also have elastic bands 32, 33 and 34 as shown in FIG. 5 that may be sewn from the side edge portion 16 to the opening of the slit 38. The elastic bands 32, 33 and 34 may improve the stretchability of the stretch material 4 on the back side 3 of the glove 1. The elastic bands 32, 33 and 34 may be sewn to the stretch material 4, for example, using a zig-zag stitch. The stitch may improve the elasticity of the elastic bands 32, 33 and 34 by expanding and/or contracting. Thus, the elastic bands 32, 33 and 34 may improve the fit of the glove 1.

The glove 1 may also have an elastic band 35 at location 36. The elastic band 35 may be within the interior 5 of the glove 1. The elastic band 35 may be sewn to the wrist panel 30 and may extend from around the palm side 2 to the back side 3 of the wrist panel 30. Thus, the elastic band 35 may extend from one side of the slit 38 to the other side of the slit 38. The elastic band 35 may improve the stretchability of the stretch material 4 at the wrist end 15. The elastic band 35 may be sewn to the stretch material 4 using a zig-zag stitch. The zig-zag stitching may improve the elasticity of the elastic band 35 by expanding or contracting accordingly. Thus, the elastic band 35 may improve the fit of the glove 1.

As shown in the FIGS. 1-7, a texture 55 may be formed and/or embossed on the finger panel 12, the thumb part 13, the palm panel 14 and/or the wrist panel 30. The texture 55 may have indentations 56 that may be configured to enhance the ability of the glove 1 to grip and/or secure a club in the hand of a user. The texture 55 may preferably be located on the glove 1 to provide added grip to the glove 1.

The present invention is not limited to the specific arrangement of the components illustrated in the figures. It should be understood that various changes and modifications to the presently preferred embodiments described herein will be apparent to those having ordinary skill in the art. Such changes and modifications may be made without departing from the spirit and scope of the present invention and without diminishing its attendant advantages. It is, therefore, intended that such changes and modifications be covered by the appended claims.

I claim:

1. A glove comprising:

(a) a body including a wrist end, a palm side, and a back side joined to the palm side at a side edge, wherein the wrist end, the palm side, and the back side are constructed from a stretch material;

(b) an index finger part, a middle finger part, a ring finger part, a pinky finger part and a thumb part;

(c) a plurality of panels, separated by stitching, comprising:

(i) a first panel attached to the stretch material on the palm side wherein the first panel forms a palm part and further wherein the first panel is separated from the other panels by the stretch material;

(ii) a second panel attached to the s palm part, wherein the second panel is continuous across at least one of the index finger part, the middle finger part, the ring finger part, and the pinky finger part;

(iii) a third panel attached to the stretch material on the palm side, wherein the third panel is also attached to the thumb part;

(iv) a back panel sewn into the stretch material of the backside; and (v) an inset panel sewn into the stretch material of the backside and separated from the back panel by an arc of the stretch material;

(d) a snap base attached to the back panel near a wrist end portion and comprising a ball marker;

(e) a slit along the back side configured to allow access to an interior of the glove and removal of the glove;

(f) a plurality of elastic bands comprising:

(i) a first elastic band sewn into an interior surface of the inset panel using a zig-zag stitch and running from the side edge to an area on the back of the hand below the first panel;

(ii) a second elastic band sewn into the interior surface of the back panel and running from the side edge portion to an opening of the slit;

(iii) a third elastic band sewn into the interior surface of the back panel and running from the side edge portion to an opening of the slit; and (iv) a fourth elastic band sewn into the wrist end and extending from around the palm side to the back side of the wrist end;

(g) a flap on the back side, the flap comprising:

(i) a top face comprising a logo patch; and (ii) a closure element wherein the closure element includes a hook-and-loop closure part operable to secure the glove onto the hand; and (h) a plurality of gussets made from an elastic material and positioned between the index finger part, the middle finger part, the ring finger part, and the pinky part.

2. The glove according to claim 1, wherein the second panel is continuous across the pinky finger part, the ring finger part, and the middle finger part, and wherein the glove further comprises a fourth panel attached to the palm side and the index finger part.

3. The glove according to claim 1, wherein the second panel is continuous across the pinky finger part and the ring finger part, wherein the glove further comprises a fourth panel that is continuous across the middle finger part and the index finger part and attached to the palm side.

4. The glove according to claim 1 wherein the second panel is continuous across the index finger part, the ring finger part, and the middle finger part, and wherein the glove further comprises a fourth panel attached to the palm side and the pinky finger part.

5. The glove according to claim 1, wherein the second panel is continuous across the ring finger part and the middle finger part, and wherein the glove further comprises:

a fourth panel attached to the palm side and the index finger part; and a fifth panel attached to the palm side and the pinky finger part.

6. The glove according to claim 1, wherein the second panel is attached to the index finger part and the palm side, and wherein the glove further comprises:

a fourth panel attached to the middle finger part and the palm side;

a fifth panel attached to the ring finger part and the palm side; and a sixth panel attached to the pinky finger part and the palm side.

7. The glove according to claim 1, wherein the plurality of panels are each made from a material comprising a leather, a synthetic leather, and polyester, a polyurethane, and a mixture thereof.

8. The glove according to claim 1, further comprising a band stitched to the back panel.

9. The glove according to claim 1, wherein the stretch material allows the glove to alter size to fit the hand.

10. The glove according to claim 1, further comprising a closure formed on the back side wherein the closure has a flexible part configured to fasten to a fixed part.

11. The glove according to claim 1, further comprising a wrist panel attached to the body and sewn to the stretch material adjacent to the wrist end, wherein the stretch material abuts the wrist panel.

12. The glove according to claim 1 further comprising a hole on at least one of the middle finger, the ring finger, the pinky finger, and the thumb part.

13. The glove according to claim 1, wherein the stretch material forms a gusset on the thumb part.

14. The glove according to claim 1, wherein the stretch material is made from at least one of a nylon, a spandex, and a polyether-polyurea copolymer.

15. The glove according to claim 1, wherein at least two of the plurality of panels, separated by stitching, are connected.

16. The glove according to claim 1, wherein the elastic material is made from a polyether-polyurea copolymer.

17. A glove comprising:

(a) a body including a wrist end, a palm side, and a back side joined to the palm side at a side edge, wherein the wrist end, the palm side, and the back side are constructed from a stretch material;

(b) an index finger part, a middle finger part, a ring finger part, a pinky finger part and a thumb part;

(c) a plurality of panels, separated by stitching, comprising:

(i) a first panel attached to the stretch material on the palm side wherein the first panel forms a palm part and further wherein the first panel is separated from the other panels by the stretch material;

(ii) a second panel attached to the s palm part, wherein the second panel is continuous across at least one of the index finger part, the middle finger part, the ring finger part, and the pinky finger part;

(iii) a third panel attached to the stretch material on the palm side, wherein the third panel is also attached to the thumb part;

(iv) a back panel sewn into the stretch material of the backside; and (v) an inset panel sewn into the stretch material of the backside and separated from the back panel by an arc of the stretch material;

(d) a snap base attached to the back panel near a wrist end portion and comprising a ball marker;

(e) a slit along the back side configured to allow access to an interior of the glove and removal of the glove;

(f) a plurality of elastic bands comprising:

(i) a first elastic band sewn into an interior surface of the inset panel using a zig-zag stitch and running from the side edge to an area on the back of the hand below the first panel;

(ii) a second elastic band sewn into the interior surface of the back panel and running from the side edge portion to an opening of the slit;

(iii) a third elastic band sewn into the interior surface of the back panel and running from the side edge portion to an opening of the slit; and (iv) a fourth elastic band sewn into the wrist end and extending from around the palm side to the back side of the wrist end; and (g) a flap on the back side, the flap comprising:

(i) a top face comprising a logo patch; and (ii) a closure element wherein the closure element includes a hook-and-loop closure part operable to secure the glove onto the hand.

18. The glove according to claim 17, wherein the second panel is continuous across the pinky finger part, the ring finger part, and the middle finger part, and wherein the glove further comprises a fourth panel attached to the palm side and the index finger part.

19. The glove according to claim 17, wherein the stretch material allows the glove to alter size to fit the hand.

20. The glove according to claim 17, wherein at least one of:

the plurality of panels are each made from a material comprising a leather, a synthetic leather, and polyester, a polyurethane, and a mixture thereof, and the stretch material is made from at least one of a nylon, a spandex, and a polyether-polyurea copolymer.

* * * * *